US009011300B2

(12) United States Patent
Hodes et al.

(10) Patent No.: US 9,011,300 B2
(45) **Date of Patent: *Apr. 21, 2015**

(54) WEIGHTED EXERCISE DEVICE PROVIDING MULTIPLE GRIPS

(71) Applicant: Leon Hodes, Great Neck, NY (US)

(72) Inventors: Leon Hodes, Great Neck, NY (US); Leonard Holtz, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/223,910

(22) Filed: Mar. 24, 2014

(65) Prior Publication Data

US 2014/0206509 A1 Jul. 24, 2014

Related U.S. Application Data

(63) Continuation of application No. 13/908,344, filed on Jun. 3, 2013, now abandoned, which is a continuation of application No. 13/618,749, filed on Sep. 14, 2012, now Pat. No. 8,454,485, which is a continuation-in-part of application No. 13/305,179, filed on Nov. 28, 2011, now Pat. No. 8,382,647.

(51) Int. Cl.

| | |
|---|---|
| ***A63B 21/072*** | (2006.01) |
| ***A63B 21/075*** | (2006.01) |
| ***A63B 23/12*** | (2006.01) |

(52) U.S. Cl.

CPC ..... *A63B 21/0726* (2013.01); *A63B 21/072* (2013.01); *A63B 21/075* (2013.01); *A63B 23/1281* (2013.01)

(58) Field of Classification Search

USPC ..... 482/44, 45, 46, 49, 50, 91, 92, 93, 106, 482/108, 109, 132, 141, 148; D21/662, D21/679, 680, 681, 682, 684, 688, 689, 787, D21/797

See application file for complete search history.

(56) References Cited

U.S. PATENT DOCUMENTS

| | | | |
|---|---|---|---|
| 113,966 | A | 4/1871 | Ballou |
| 2,447,218 | A | 8/1948 | Trzesniewski |
| 2,878,858 | A | 3/1959 | Winchester |
| 3,185,476 | A | 5/1965 | Fechner |
| D203,052 | S | 11/1965 | Erhard |

(Continued)

OTHER PUBLICATIONS

Http://www.dragondoor.com/shop-by-department/equipment Accessed by Applicants on Nov. 22, 2011 at 3:56 PM.

(Continued)

*Primary Examiner* — Loan H Thanh
*Assistant Examiner* — Sundhara Ganesan
(74) *Attorney, Agent, or Firm* — Holtz, Holtz, Goodman & Chick PC

(57) ABSTRACT

Weighted and stackable exercise device includes a body defining a hollow cavity opening at a first edge thereof. The body has a side wall having at least one cut-out. An outwardly projecting rim is arranged on the tubular portion of the body. A handle is arranged in the cavity. The rim provides a first grip for a user during use of the exercise device and the handle provides a second grip for the user. By providing different grips on the same weighted exercise device, a user can safely and efficiently perform a larger variety of exercises in comparison to using conventionally shaped exercise devices that include only a single type of grip. The user can also pass their fingers and hand from an exterior of the device through each cut-out and over the rim to grip the device in another manner and perform even more and different exercises using the exercise device.

22 Claims, 8 Drawing Sheets

(56) References Cited

U.S. PATENT DOCUMENTS

| | | | |
|---|---|---|---|
| 3,990,699 | A | 11/1976 | Urmston |
| 4,801,140 | A | 1/1989 | Bergeron |
| 4,813,669 | A | 3/1989 | Caruthers |
| 4,880,228 | A | 11/1989 | Caruthers |
| 4,896,880 | A | 1/1990 | Caruthers |
| 4,900,016 | A | 2/1990 | Caruthers |
| D321,230 | S | 10/1991 | Leonesio |
| D343,880 | S | 2/1994 | Shelton et al. |
| 5,342,268 | A | 8/1994 | Caruthers |
| D383,646 | S | 9/1997 | Jeppesen et al. |
| 5,853,355 | A | 12/1998 | Standish |
| 6,001,049 | A | 12/1999 | Frey |
| D432,602 | S | 10/2000 | Savage |
| 6,672,993 | B2 | 1/2004 | Stout |
| D515,652 | S | 2/2006 | McCreath |
| 7,011,611 | B1 | 3/2006 | Ripley |
| 7,300,389 | B2 | 11/2007 | Lien et al. |
| D565,356 | S | 4/2008 | Mellen et al. |
| D575,992 | S | 9/2008 | LeGreve et al. |
| 7,585,262 | B1 | 9/2009 | Vayntraub |
| D616,949 | S | 6/2010 | Wang |
| 7,785,240 | B2 | 8/2010 | Stugart |
| D651,671 | S | 1/2012 | Ross et al. |
| 2003/0134727 | A1 | 7/2003 | Yu |
| 2004/0259691 | A1 | 12/2004 | Stout et al. |
| 2007/0142188 | A1 | 6/2007 | Lien |
| 2007/0238578 | A1 | 10/2007 | Landfair |
| 2007/0287600 | A1 | 12/2007 | Prenatt |
| 2009/0075792 | A1 | 3/2009 | Stugart |
| 2010/0069206 | A1 | 3/2010 | Viselman |
| 2010/0130337 | A1 | 5/2010 | Stewart |
| 2011/0028285 | A1 | 2/2011 | Towley, III et al. |

OTHER PUBLICATIONS http://fitter1.com/Catalog/Items/BBELL.aspx Accessed by Applicants on Nov. 28, 2011 at 2:21 PM.

http:://www.bosu.com/scripts/cgiip.exe/WService=BOSU/itemdetl.html?item=BOSU_Sport45&lvl1=1&lvl2=H Accessed by Applicants on Nov. 28, 2011 at 3:03 PM.

International Search Report and Written Opinion dated Sep. 17, 2013 (in English) issued in counterpart International Application No. PCT/US2013/043365.

WEIGHTED EXERCISE DEVICE PROVIDING MULTIPLE GRIPS

CROSS REFERENCE TO RELATED APPLICATION

This application is a Continuation of U.S. application Ser. No. 13/908,344, filed Jun. 3, 2013. U.S. application Ser. No. 13/908,344 is a Continuation of U.S. application Ser. No. 13/618,749 filed Sep. 14, 2012 and issued as U.S. Pat. No. 8,454,485 on Jun. 4, 2013. U.S. application Ser. No. 13/618,749 is a Continuation-In-Part of U.S. application Ser. No. 13/305,179 filed Nov. 28, 2011 and issued as U.S. Pat. No. 8,382,647 on Feb. 26, 2013. All the above applications are incorporated by reference herein.

FIELD OF THE INVENTION

The present invention relates generally to a weighted device for use in exercising, and more particularly to generally hemispherical weighted exercise devices for use in exercising and which can be gripped in two or more different ways to thereby enable their use for a wide range of exercises.

The present invention also relates to a stackable weighted exercise device.

BACKGROUND OF THE INVENTION

Dumbbells are often used in muscle-building or muscle-toning exercises. However, a traditional dumbbell, i.e., a pair of weights connected by a short bar serving as a handle, is not appropriate for all exercises and alternative forms of weights have been developed for different exercises.

One weighted exercise device that was considered to be particularly useful for gymnastic exercises is disclosed in U.S. Pat. No. 113,966 (Ballou) and comprises a spherical or spheroidal lower part that is elongated or extended on one side. The weighted exercise device includes a hollow cavity and includes an opening in the elongated or extended part leading into the cavity. A handle extends across the cavity and is positioned to enable a user to extend their hand into the cavity and grasp the handle. The only manner in which this weighted exercise device may be used is by gripping the handle Other weighted exercise devices include those disclosed in U.S. Pat. Nos. 4,813,669; 4,880,218; and 4,900,016 (all to Caruthers).

Another exercise device is a Bosu balance trainer that has a rim that can be gripped. This balance trainer is constructed of rubber and plastic and is not weighted.

OBJECTS AND SUMMARY OF THE INVENTION

It is an object of the present invention to provide a weighted device for use in exercising.

A weighted exercise device in accordance with the invention includes a body defining a hollow cavity opening at a first edge of the body. The body has a rounded or hemispherical portion and a tubular portion extending to one side of the hemispherical portion. A rim is arranged on the tubular portion of the body and projects outwardly past an outer surface of the body. A handle is arranged in the cavity. The rim provides a first grip for a user during use of the exercise device and the handle provides a second grip for the user during use of the exercise device.

Another way to consider the exercise device in accordance with the invention is as one that includes a body defining a hollow cavity opening at a first edge of the body, a first grip arranged in connection with the body and adapted to be gripped by one or both hands of a user, and a second grip arranged in the cavity and adapted to be gripped by only one hand of the user. The first grip is arranged proximate the first edge and projects outwardly past an outer surface of the body.

By providing two different grips on the same weighted exercise device, a user can perform a larger variety of exercises using the invention in comparison to exercise devices that include only a single type of grip.

The body has a rounded or generally hemispherical shape that provides a better, safer, and more efficient exercise experience than traditional dumbbells.

To enable yet additional grips on the same weighted exercise device, and thus increase the variety of exercises that can be performed using the invention, one or more cut-outs may be formed in a side wall of the body. Each cut-out may be formed partly in the curved or hemispherical portion and partly in the tubular portion of the side wall of the body. Suitable dimensioning of the cut-outs is designed to enable the user to insert part of one of their hands through each cut-out and then over the rim in order to grip a portion of the device between the cut-out and the rim. When gripping the device with one or both hands in this manner, the user can perform for example, a floor or swinging exercise, or can more easily carry the exercise device.

In any of the embodiments of the weighted exercise device described above, the side wall of the body may be provided with a step and the opening into the cavity has a size greater than or equal to the outer diameter of the body at the step to enable multiple weighted exercise devices to be stacked one on top of another. The step may be provided in the hemispherical portion, in the tubular portion or between the hemispherical portion and the tubular portion.

Other objects of the present invention are attained in accordance with the weighted exercise device of the present invention which are described hereinafter.

BRIEF DESCRIPTION OF THE DRAWINGS

The invention, together with further objects and advantages thereof, may best be understood by reference to the following description taken in conjunction with the accompanying drawings, wherein like reference numerals identify like elements.

DETAILED DESCRIPTION OF THE INVENTION

Figure 1:
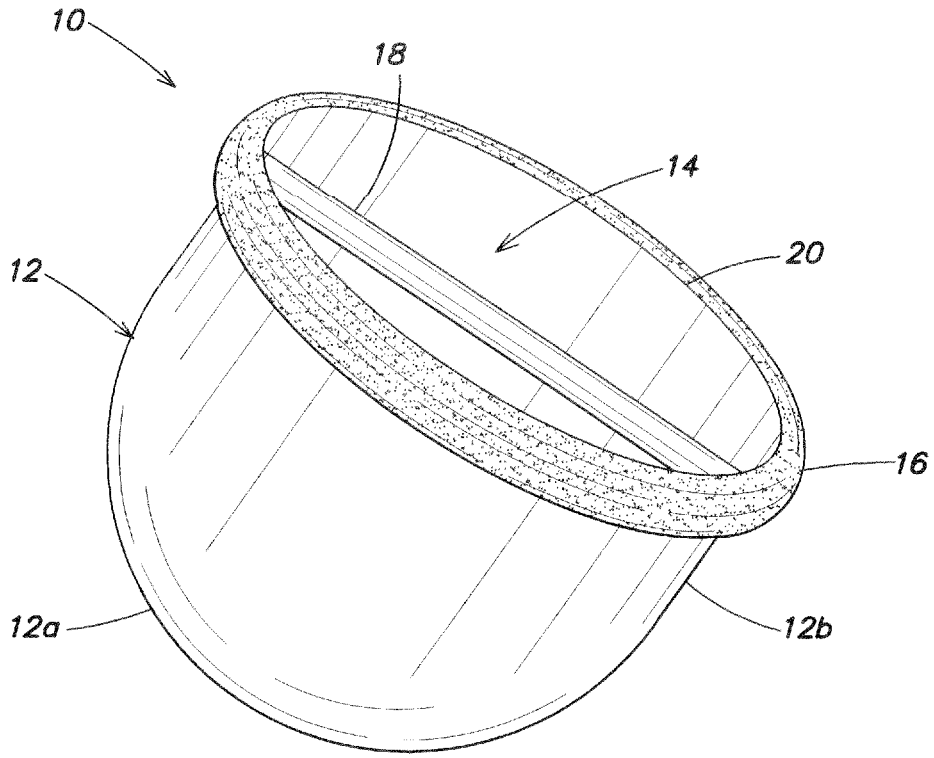
FIG. 1 is a perspective view of a first embodiment of a weighted exercise device in accordance with the invention.

Referring to the accompanying drawings wherein like reference numerals refer to the same or similar elements, a weighted exercise device in accordance with the invention is designated generally as 10 and includes a generally hemispherical main body 12 defining a hollow cavity 14 and having a rim 16 adjacent its upper edge 20 (the top edge 20 when the weighted exercise device is positioned as shown in FIG. 1). By being generally hemispherical, it is preferred that the body 12 has a generally hemispherical portion 12*a* and a small extended or elongated portion (tubular portion) 12*b* extending from the generally hemispherical portion 12*a* (see FIGS. 1 and 4). Body 12 thus has a generally acorn shape. The extended or elongated portion 12*b* is tubular in view of the formation of part of the cavity 14 therein.

Figure 4:
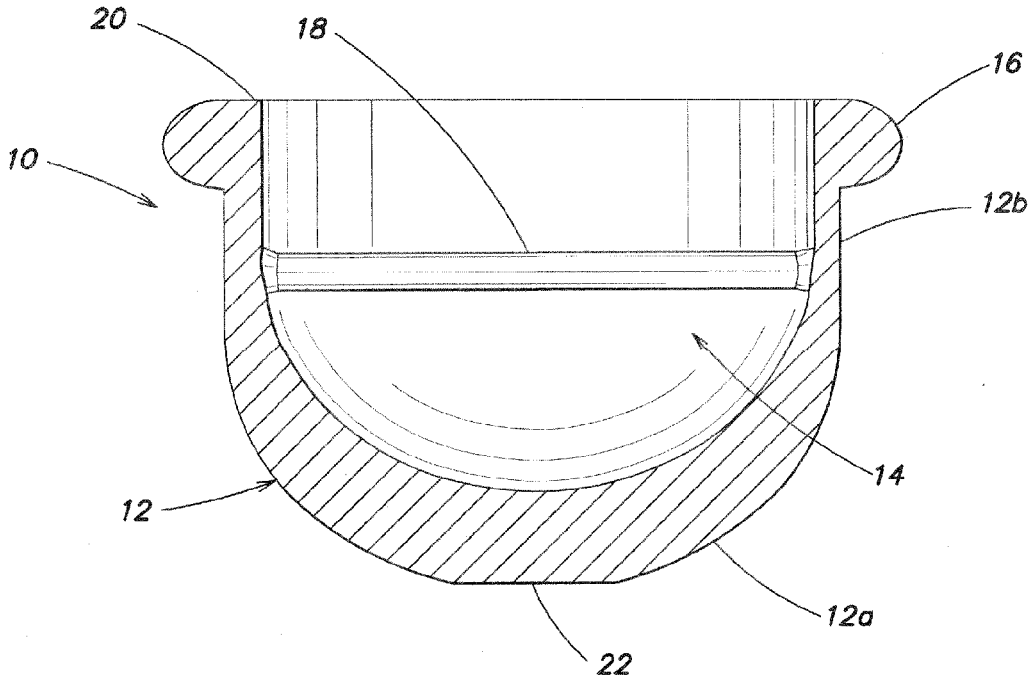
FIG. 4 is a cross-sectional view of the weighted exercise device shown in FIG. 1.

The rim 16 preferably extends around the entire circumference of the body 12 (see FIG. 1) and more particularly, is situated on the extended or elongated portion 12*b* of the body 12 (see FIG. 4). Rim 16 may either be considered an integral part of the body 12 or a separate part that is connected to the body 12.

The outer surface of the body 12 is provided with a unique shape in view of the presence of the projecting rim 16. At the bottom edge, the outer surface of the body 12 has a substantially hemispherical portion (in portion 12*a*), then has a generally cylindrical surface portion (in portion 12*b*) and then an outwardly projecting rounded portion (rim 16). As such, the rim 16 projects outwardly in a radial direction past the extended or elongated portion 12*b*, i.e., beyond the outer surface of this tubular portion of the body 12. This unique shape is partially shown in FIG. 4. The thickness of the tubular portion 12*b* is preferably uniform so that the cylindrical surface portion does not taper inward.

The size of the extended or elongated portion 12*b* of the weighted exercise device 10 may be dependent on, for example, the size of the hands of the user intended to use the weighted exercise device 10. The size of the extended or elongated portion 12*b* also affects the size of the cavity 14, i.e., a larger extended or elongated portion 12*b* results in a larger cavity 14. The weighted exercise device 10 should accommodate most users. However, a user with unusually large hands may prefer a weighted exercise device 10 that has a larger extended or elongated portion 12*b* and thus a larger cavity 14 than a user with smaller hands. Different size weighted exercise devices 10 may be manufactured with different weights. The larger weights would be of larger size. A set of different-weight exercise devices 10 could be assembled together and sold as a unit.

Rim 16 is preferably rounded and beveled (see FIG. 4), and serves as a hand grip for a user to grip or grasp the weighted exercise device 10 with one or two hands when performing an exercise. In cross-section, the rim 16 has a substantially semi-circular form thereby providing an easily grippable form for the user's hand.

Rim 16 is therefore a first grip of the weighted exercise device 10. Most often, the user would grip or grasp the rim 16 with both of their hands when performing an exercise, although the user could also grip or grasp the rim 16 with only one of their hands for certain exercises.

A second grip of the weighted exercise device 10 is provided by a handle 18 that extends across the hollow cavity 14 formed in the hemispherical body 12. Handle 18 is substantially cylindrical, or may be tubular, and is preferably rigid. Handle 18 may be formed integral with the body 12 or separated therefrom and then attached to the body 12 in a preferably permanent manner, e.g., by welding.

Handle 18 may be positioned a distance inward from the top edge 20 of the hemispherical body 12, i.e., recessed within the cavity 14. Handle 18 is also spaced a distance from the bottom of the cavity 14 so that the user's fingers have room to pass freely around the handle 18 and grasp it comfortably.

The recess distance varies depending, for example, on the size and weight of the weighted exercise device 10 (see FIG. 4). This distance may be determined during design of the weighted exercise device 10 in consideration of the location of the center of gravity of the weighted exercise device 10. More specifically, in one embodiment, it is desirable for the handle 18 to be close to or at the center of gravity of the device. As such, when one of the user's hands is gripping the handle 18, the center of gravity is close to where the hand is, thereby providing a safer and more balanced exercise experience.

On the other hand, when the user is using the rim 16 as the grip, and using both hands as in a preferred use, the center of gravity is away from the user's hands for performing certain exercises.

Figure 6:
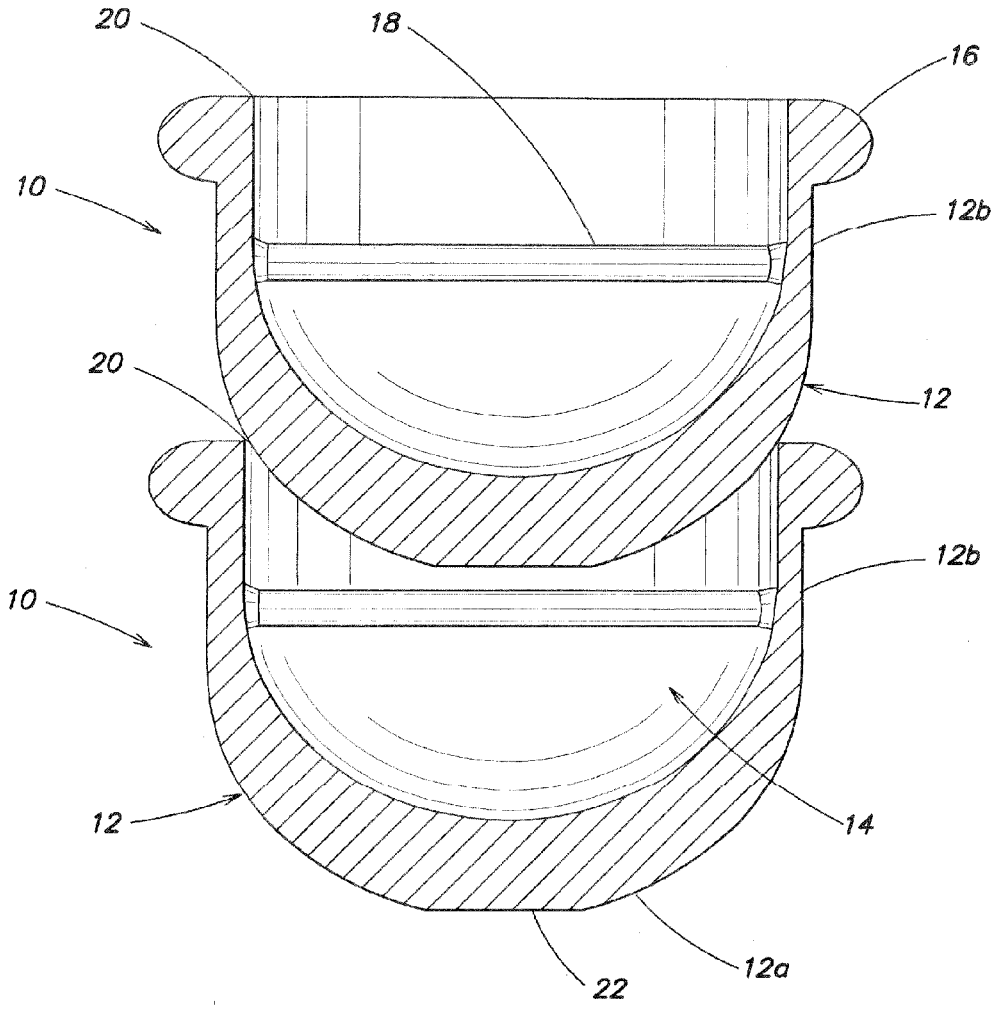
FIG. 6 shows two stacked exercise devices.

As shown in FIG. 6, an advantage of the recessing of the handle 18 in the cavity 14 is that the weighted exercise device 10 is thus stackable, i.e., multiple weighted exercise devices 10 may be stacked one on top of another with, in each adjacent pair of weighted exercise devices, a portion of an upper weighted exercise device sitting in the cavity 14 defined by a lower weighted exercise device. More than two devices could be stacked. A convenient space saving design is therefore provided.

Figure 2:
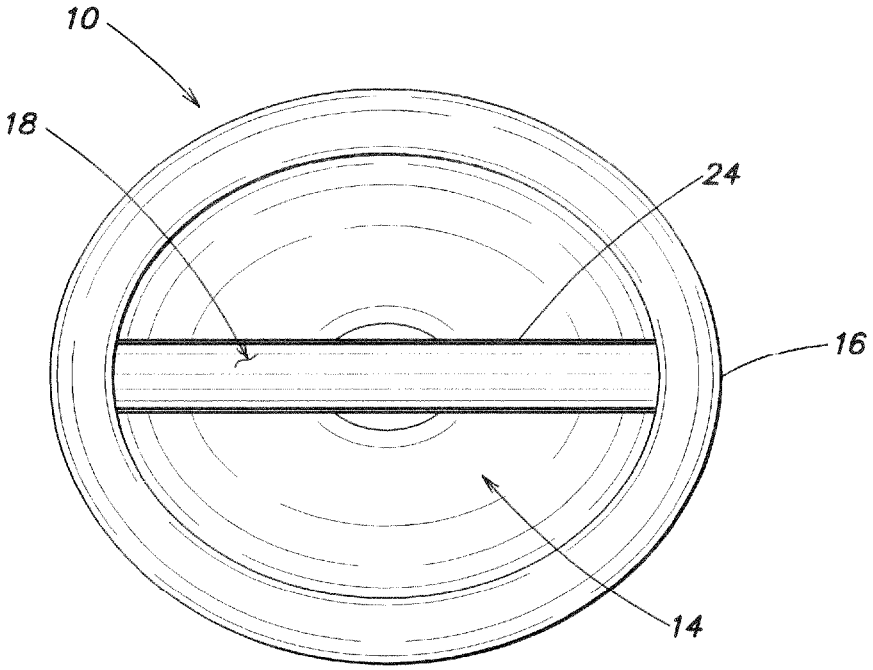
FIG. 2 is a top view of the weighted exercise device shown in FIG. 1.

Handle 18 is optionally provided with a coating 24 on its outer surface to provide a better and/or more comfortable grip to the user (see FIG. 2). The coating 24 may be made of rubber, or any other material that improves the grip, and may be textured or grooved. Alternatively, the outer surface of the handle 18 itself may be textured or grooved to improve the user's grip thereof.

Figure 3:
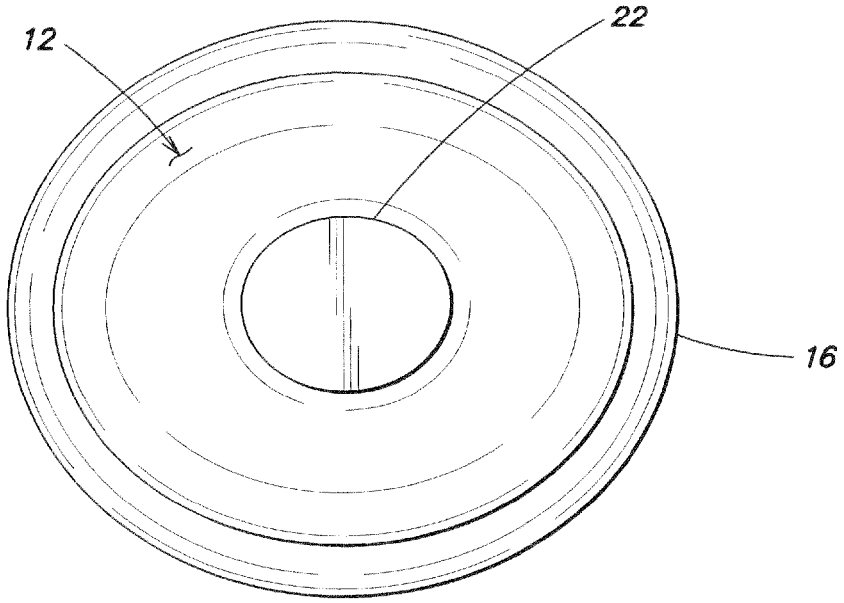
FIG. 3 is a bottom view of the weighted exercise device shown in FIG. 1.

Referring now in particular to FIGS. 3 and 4, the generally hemispherical body 12 also includes a slightly flattened area 22 at a bottom, i.e., encompassing the bottom edge, in order to enable the weighted exercise device 10 to be stably placed onto a flat horizontal surface. Flattened area 22 is not required to be completely flat, and it may just be tapered. Its presence enables the weighted exercise device to be balanced and rest upright, in the position shown in FIG. 4, if placed carefully on a floor or other horizontal surface. The flattened area 22 also enables the user to do push-up type exercises, rotate one's hands, and/or rotate his body while exercising, thereby utilizing core muscles. This can be done with one device, where the user grips the one device with two hands, or this can be done with two devices, where the user grips one device in each hand.

Figure 5:
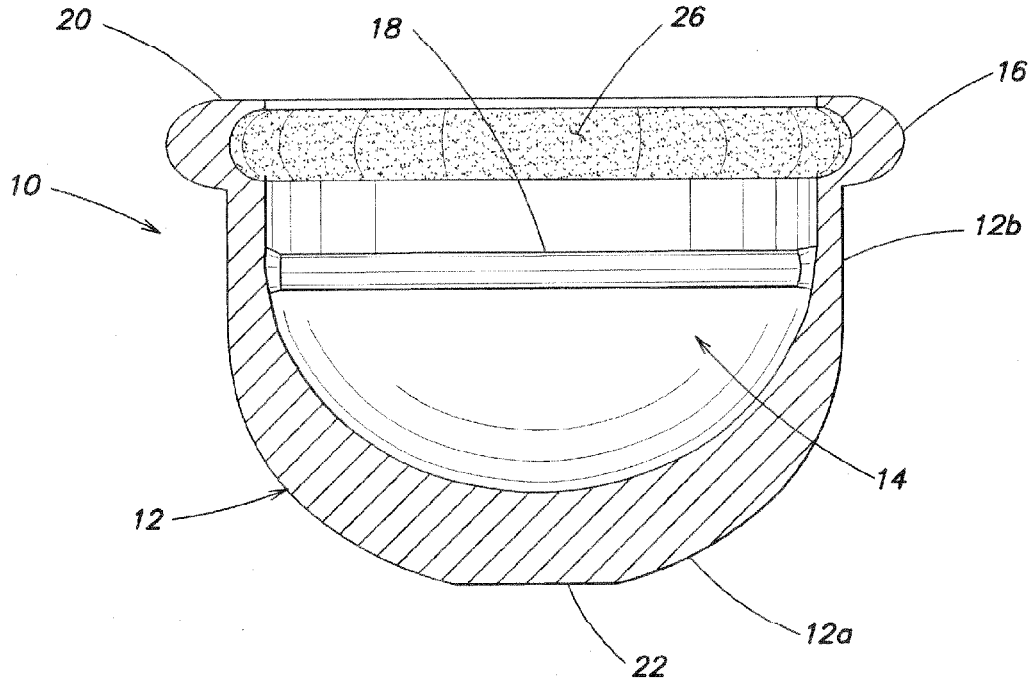
FIG. 5 is a cross-sectional view of a second embodiment of a weighted exercise device in accordance with the invention.

Variations to the shape and/or form of the weighted exercise device 10 described above are envisioned. For example, the outer surface of the rim 16 may be textured (as shown in FIG. 1) and/or an interval groove 26 may be arranged in connection with the rim 16. FIG. 5 shows such a groove 26 having a generally semi-circular cross-section which is formed opposite or in the rim 16.

In cross-section, groove 26 has a smaller semi-circular form than the cross-sectional form of the entire rim 16. The thickness of the rim 16 (in cross-section) is therefore varied, increasing from a smaller thickness adjacent the tubular portion of the extended and elongated portion 12*a* to a larger thickness at the largest radius of the rim 16 and then decreasing to a smaller thickness at the top edge 20 of the body 12 (see FIG. 5).

In use, groove 26 may accommodate a thumb of the user while handling or lifting the weighted exercise device 10 so that the user is better able to handle the weighted exercise device 10 by placing the thumb on the inside of the body 12 and the remaining fingers around the projecting rim 16 on the outside of the body 12. The surface of the groove 26 may be textured in the same manner as shown for the rim 16 in FIG. 1. In this case, the rim 16 is more securely gripped between the thumb on the inside thereof and the remaining fingers on the outside thereof.

More generally, depending on the size and depth of the groove, the groove 26 serves as an indentation in the inner surface of the body 12 and thereby improves the ability of the user to grasp the rim 16 and exercise device 10 in its entirety, since their thumb and/or other fingers will be able to engage with, i.e., partly enter into, the groove 26. As such, the depth of the groove 26 may be preferably in the order of the thickness of an average human thumb or finger.

The weighted exercise device 10, in any of its forms and shapes described above, may be used for a wide variety of exercises, only some of which are identified herein. For example, the weighted exercise device 10 may be used as traditional dumbbells in pairs to perform bicep curls, clean and jerky movements, military presses, bench presses, or swinging type exercises typically performed with kettlebells. In addition, the weighted exercise device 10 may be used for floor exercises, such as push-ups, using either a single weighted exercise device with the user's two hands gripping the rim 16 or two weighted exercise devices 10 with each of the user's hands gripping the handle 18 of a respective weighted exercise device 10.

The weighted exercise device 10 may also be used for wrist and forearm rehabilitation exercises with the user grasping the handle 18, positioning the flattened area 22 against a flat surface, and turning the weighted exercise device 10 to either side on the flat surface. The weighted exercise device 10 could be rotated and turn on the rim 16.

Furthermore, the weighted exercise device 10 can be used by a user, while standing or sitting, and for floor exercises because they are designed to be used for the same exercises that involve traditional dumbbells and kettlebells. For example, when performing push-up type exercises, the user can rotate and pivot, and can shift his body weight. These actions utilize core and stabilization muscles thereby providing a highly efficient exercise for the user using the weighted exercise device 10. The device of the present invention takes the place of both dumbbells and kettlebells.

The weight of the weighted exercise device 10 is provided primarily by the hemispherical body 12, along with a smaller contribution to the weight by the handle 18. To this end, the body 12 is provided with a thickness and material composition to provide a desired weight, e.g., 1 lb, 2 lb, 5 lb or more. If the same material is used, the weighted exercise device is larger as the weight increases. With smaller weights, for example a 5 lb weight, the slight elongation to a slightly oval shape (see FIGS. 2 and 3) will ensure more space in the cavity 14. Sets of weighted exercise devices 10 may be assembled with different weights of the weighted exercise devices, e.g., from 1 lb to about 15 lbs with increments of 1, 2 or 3 lb. Higher weights, such as 20 lb, 25 lb, 30 lb, 35 lb, 40 lb, and 50 lb or more can also be made. A mark or indication of the weight of each weighted exercise device in the set may be placed on the body 12 in an easily visible location. As the weights get heavier, the device has another advantage: because the device is generally hemispherical, the weight is evenly distributed and is easier and safer to handle. Moreover, the size is not as large as conventional dumbbells, thereby being easier to use, especially in pairs.

Figure 7:
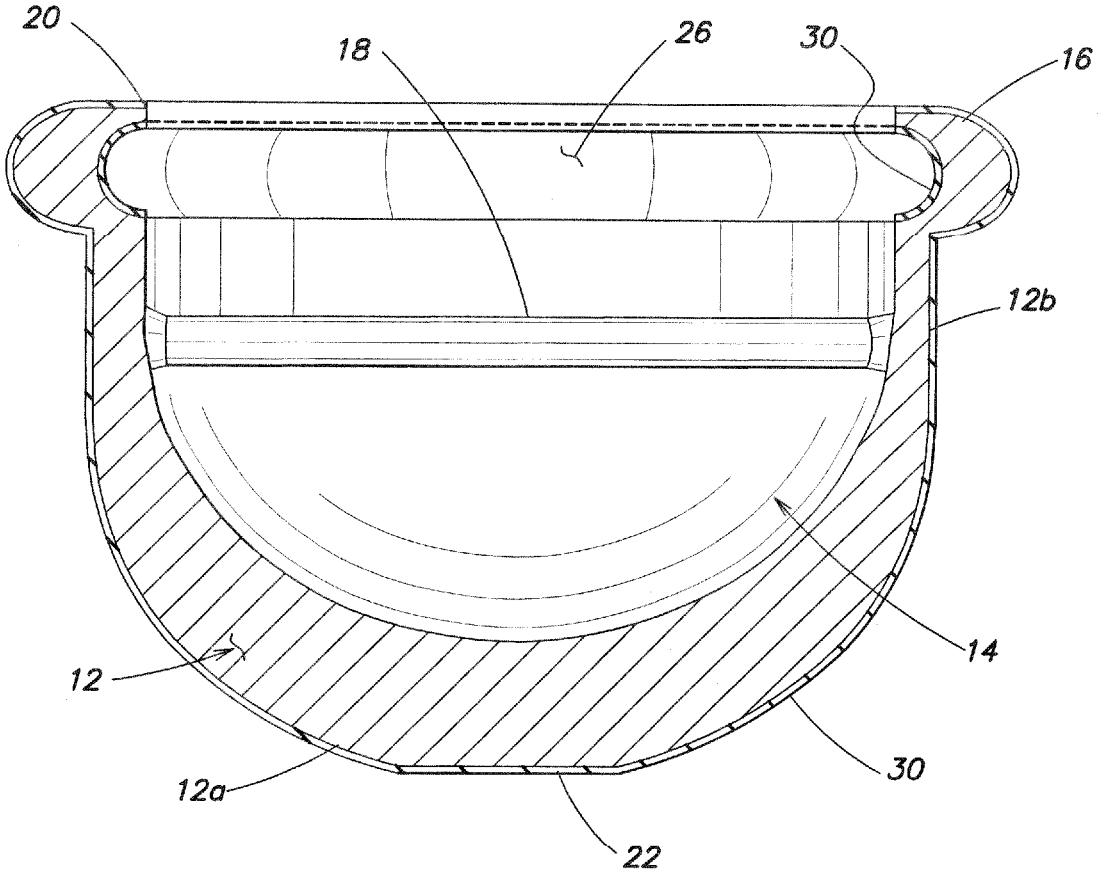
FIG. 7 shows an embodiment with a rubberized coating.

In another embodiment, as shown in FIG. 7, the outer surface of the weighted exercise device 10, i.e., the outer surface of the body 12 and/or rim 16, is rubberized and/or color-coded. Rubberizing the weighted exercise device 10 (i.e., by providing a thin outer rubber-like coating 30 on the entire device) enables two or more of the weighted exercise devices 10 to be stacked together (as in FIG. 6) without allowing metal-to-metal contact. Further, the rubber coating on the outer surface of the body 12 and/or rim 16 prevents damage to surfaces against which the weighted exercise device 10 is used, e.g., flooring or furniture. Instead of a rubber material, a plastic material could be used for the coating 30. In one embodiment, is possible to only color the rim 16 so that different colored rims are provided in a set of weighted exercise devices. A mark or indication of the weight of each weighted exercise device may be placed on the colored rim.

The rubberized or rubber-like coating 30 on the groove 26 improves gripping by the user.

Weighted exercise device 10 may be made from a single piece of cast iron or other similar, heavy density material. The casting process may be designed to provide the body 12 with the cavity 14 and rim 16. The handle 18 may either be formed during the casting or formed separately and attached to opposed portions of the inner surface of the body 12 at the desired distance from the top edge 20 of the body 12. The groove 26 may also be formed in the casting or molding. Casting is not the only manner in which the weighted exercise device 10 may be formed but is only an exemplifying method. One skilled in the art would readily understand how to manufacture the weighted exercise device 10 using other material processing techniques from the disclosure herein.

Figure 9:
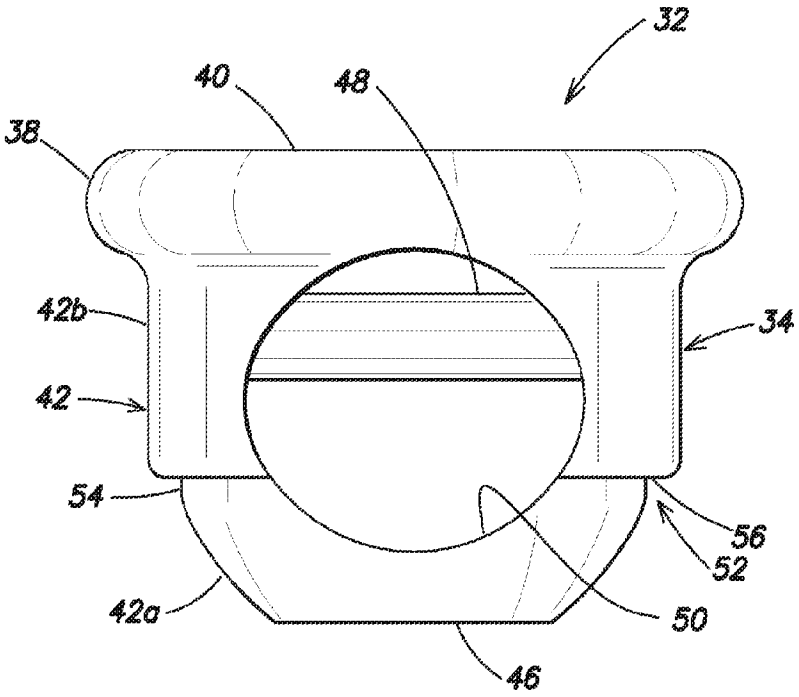
FIG. 9 is a left side view of the weighted exercise device shown in FIG. 8.
Figure 8:
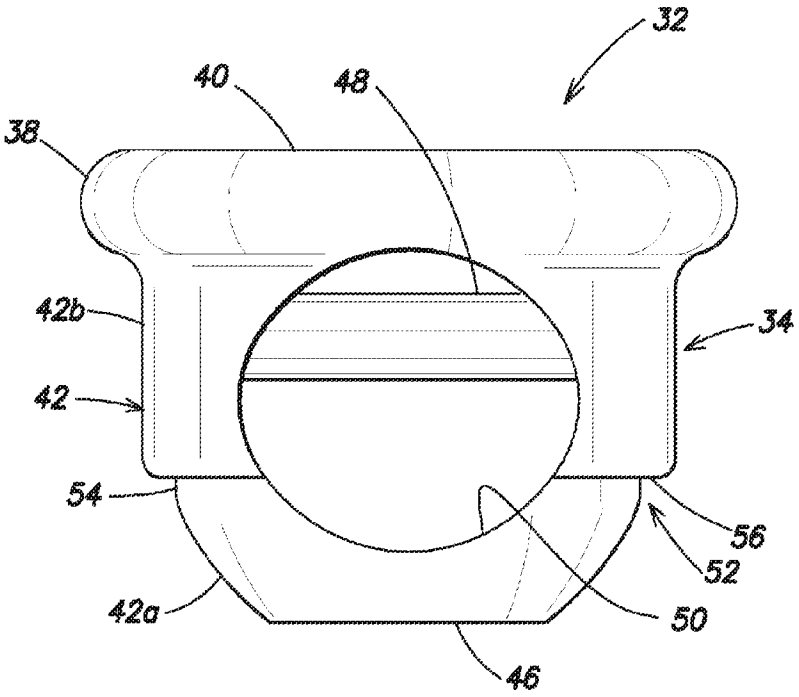
FIG. 8 is a right side view of a third embodiment of a weighted exercise device in accordance with the invention.

Referring now to FIGS. 8-12, another embodiment of a weighted exercise device in accordance with the invention is designated generally as 32 and includes a main body 34 defining a hollow cavity 36 and having a projecting rim 38 adjacent its upper edge 40 (the top edge 40 when the weighted exercise device 32 is positioned as shown in FIGS. 8 and 9).

Main body 34 has a side wall 42 having a truncated or flattened hemispherical portion **42*a* and an extended or elongated portion 42*b* extending from the flattened hemispherical portion 42*a* (see FIGS. 8 and 9). The extended or elongated portion 42*b* is generally tubular, i.e., a tubular portion, and forms part of the cavity 36 therein. At the bottom of the side wall 42, the main body 34 has a bottom wall 44 with a substantially flat and planar bottom surface 46**.

The rim 38 preferably extends around the entire circumference of the body 34 (see FIGS. 10 and 11) and is situated on the extended or elongated portion **42*b* of the body 34 (see FIGS. 8 and 9). Rim 38 may include the same features and incorporate the same modifications and variants as rim 16 of exercise device 10** described above, e.g., a groove on the inner side.

Figure 11:
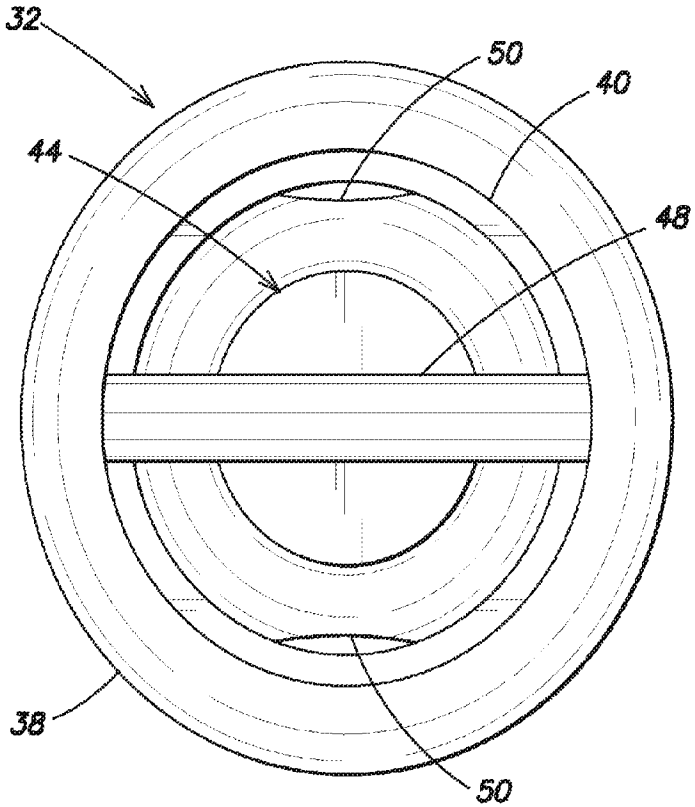
FIG. 11 is a top view of the weighted exercise device shown in FIG. 8.
Figure 10:
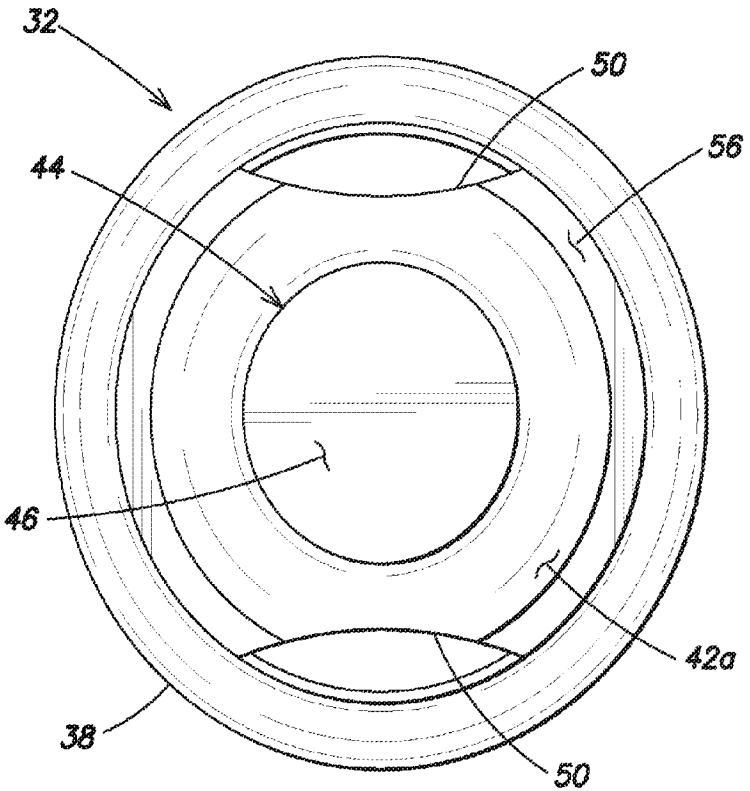
FIG. 10 is a bottom view of the weighted exercise device shown in FIG. 8.

The exercise device 32 also includes a handle 48 that extends across the hollow cavity 36 formed in the main body 34 (see FIG. 11). Handle 48 may include the same features and incorporate the same modifications and variants as handle 18 of exercise device 10 described above.

Handle 48 may be positioned a distance inward from the top edge 40 of the main body 34, i.e., recessed within the cavity 36. Handle 48 is also spaced a distance from the bottom of the cavity 36 so that the user's fingers have room to pass freely around the handle 48 and grasp it comfortably.

To increase the number of uses of exercise device 32, one or more cut-outs 50 are formed in the side wall 42 of the main body 34. In the embodiment illustrated in FIGS. 8-12, two cut-outs 50 are formed, each partly in the hemispherical portion 42*a* of the side wall 42 and partly in the extended or elongated portion 42*b* of the side wall 42.

Cut-outs 50 are generally oval and extend from a point below the handle 48 to a point above the handle 48. Two cut-outs 50 may be provided on opposite sides of the main body 34, as shown in FIGS. 8 and 9, and may, but are not required to, align with one another. Cut-outs 50 may have a shape other than oval as shown, and may be provided in any number.

Suitable dimensioning of the cut-outs 50, i.e., selection of their size, enables the user to insert a respective one of their hands through each cut-out 50 and over the rim 38 in order to grip a portion of the main body 34 between the cut-out 50 and the rim 38. The user can perform exercises with their hand(s) in this position, e.g., floor or swinging exercises. This position also enables the user to more easily carry the exercise device 32.

The outer surface of the main body 34 is provided with a unique profile and shape in view of the presence of the projecting rim 38 and a step 52 formed in the side wall 42 between the flattened hemispherical portion 42*a* and the extended or elongated portion 42*b* (and which is traversed by the cut-outs 50). This unique shape is shown best in FIGS. 8 and 9.

Figure 12:
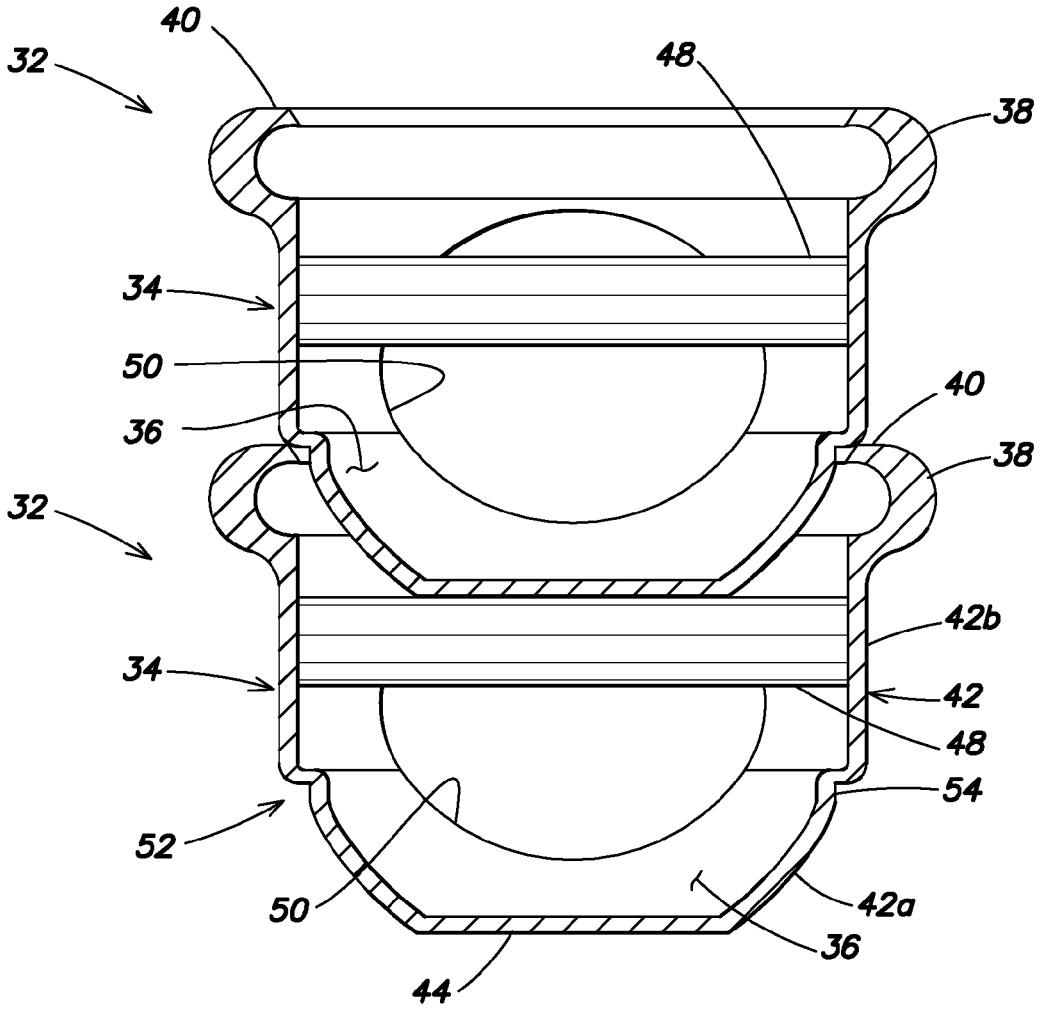
FIG. 12 is a cross-sectional view of two of weighted exercise devices shown in FIG. 8 stacked one on top of another.

Step 52 is formed to enable the hemispherical portion 42*a* of one exercise device 32 to be positioned partly in the cavity 36 of another exercise device 32, i.e., enable multiple exercise devices 32 to be stacked one on top of another as shown in FIG. 12. To provide this partly nesting configuration, the outer diameter of an outer-facing surface 54 of the hemispherical portion 42*b* of the side wall 42 at the step 52 is the same as or slightly smaller than the inner diameter of the upper portion of the rim 38 adjacent the top edge 40 thereof.

To aid in the secure and stable stacking of multiple exercise devices 32, the height of the hemispherical portion 42*a*, i.e., the dimension from the flat bottom surface 46 to the bottom-facing surface 56 of the step 52, is preferably substantially the same as the distance between the upper edge of the handle 48 and the top edge 40 of the main body 34 (see FIG. 12). In this case, the flat bottom surface 46 of one exercise device 32 will rest on the handle 48 of another while the step 52 of that same exercise device 32 will rest on the top edge 40 of the other exercise device, i.e., a dual point of contact fitting which provides significant stabilization benefits.

In other respects, both constructional and use, exercise device 32 is similar to exercise device 10, including having an internal groove 26 arranged in connection with the rim 38 and the manner of use by gripping rim 38 and handle 48. As such, all of the features of exercise device 10 may be incorporated into exercise device 32, and vice versa. For example, a rubber-like coating (not shown) may be provided on the outer surface of the weighted exercise device 32, i.e., the outer surface of the main body 34, the rim 38 and/or the inner surface of the main body 34 including the groove in the rim 38. Rubberizing the weighted exercise device 32 avoids metal-to-metal contact when stacking the exercise devices 32.

The weighted exercise devices 10 described above constitute an improvement over prior art weighted exercise devices in that they have two grips or gripping portions, one defined by the rim 16 (with or without groove 26) and another defined by the handle 18. The presence of these two gripping portions significantly increases the functionality of the weighted exercise device 10 because while a weight with a handle intended to be gripped by one hand of a user enables a limited number of exercises to be performed and a weight with a grip intended to be gripped by both hands of the user enables another limited number of different exercises to be performed, by providing both types of grips in a single weighted exercise devices, all of the exercises using either type of grip can be performed using only the weighted exercise device in accordance with the invention.

The weighted exercise devices of the present invention provide an advantage over traditional dumbbells in that they are substantially hemispherically shaped, which provides a symmetrical device, wherein the weight is substantially evenly distributed circumferentially around the handle 18 as compared to a conventional dumbbell wherein the weight is concentrated on two sides of a gripping bar portion. This is an important distinction for certain exercises in order to prevent injury, particularly for exercises where the weight is lifted above the head. The exercise device of the present invention has a symmetrical, circumferentially distributed weight, and provides a safer exercise experience.

The weighted exercise device of the present invention can be used as both a kettlebell and a traditional dumbbell. Also, the weighted exercise devices of the present invention can be used with the outer rounded portion on the floor to pivot and rotate while the handle 18 is being gripped by the user so as to more efficiently use the core muscles in a way that either kettlebells or dumbbells cannot. The weighted exercise device of the present invention can also be used more safely as a swinging device since there are no outwardly projecting members (as in conventional dumbbells or kettlebells). The rounded substantially hemispherical shape provides a smooth curved outer surface that reduces the possibility of injury to the user when using the weights while performing a swinging exercise, or when using the weights in an aerobic class or the like. Users can more safely use the device to perform a plethora of exercises without having to change devices.

The present invention therefore is a weighted exercise device that improves on existing weighted exercise devices by expanding possible uses thereof thereby increasing the number of exercises that can be performed with the weighted exercise device and improving safety for the user.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. An exercise device, comprising:

a body defining a hollow cavity which opens at a first edge of said body, said body having a wall with at least one cut-out defined therein;

a rim which is integrally formed with said body and having a thickness greater than a thickness of said wall, wherein said rim is proximate to and continuous around an entirety of said first edge of said body, wherein a portion of said wall of said body extends beneath said rim, wherein said at least one cut-out is defined in said body beneath said rim, and wherein said rim provides a grip for a user; and a single handle arranged in said cavity, wherein said handle provides a grip for a user during use of the exercise device, and wherein the user can pass at least a part of a hand through said at least one cut-out to grip said main body.

2. The exercise device of claim 1, wherein said at least one cut-out comprises two cut-outs.

3. The exercise device of claim 2, wherein said two cut-outs are arranged on opposite sides of said body and align with one another.

4. The exercise device of claim 1, wherein said at least one cut-out has a substantially oval shape.

5. The exercise device of claim 1, wherein said body comprises a side wall which includes (i) a curved wall portion and (ii) an extended or elongated portion extending upwardly from said curved wall portion.

6. The exercise device of claim 5, wherein said at least one cut-out is situated partly in said curved wall portion and partly in said extended or elongated portion.

7. The exercise device of claim 1, wherein said at least one cut-out extends on said body from a point below said handle to a point above said handle.

8. The exercise device of claim 1, wherein said body further comprises a groove arranged in an inner surface of said body defining said cavity and opposite said rim.

9. The exercise device of claim 1, wherein said body comprises a side wall having a step portion at which an outer diameter of said side wall changes, and wherein an inner diameter of said body at said first edge is substantially equal to or slightly greater than the outer diameter of said side wall at said step portion, thereby enabling stacking of multiple devices on top of one another.

10. The exercise device of claim 9, wherein said side wall includes (i) a curved wall portion and (ii) an extended or elongated portion extending upwardly from said curved wall portion, said step portion being situated between said curved wall portion and said extended or elongated portion.

11. The exercise device of claim 9, wherein a height of said side wall from a bottom surface of said side wall to a bottom-facing surface of said step portion is a substantially same height as a distance between an upper edge of said handle and said first edge of said body.

12. A stackable exercise device, comprising:

a body defining a hollow cavity which opens at a first edge of said body, wherein a side wall of said body has at least one cut-out defined therein and comprises a step portion at which an outer diameter of said side wall changes, and wherein an inner diameter of said body at said first edge is substantially equal to or slightly greater than the outer diameter of said side wall at said step portion;

a rim which is integrally formed with said body and having a thickness greater than a thickness of said side wall, wherein said rim is proximate to and continuous around an entirety of said first edge of said body, wherein a portion of said side wall of said body extends beneath said rim, and wherein said rim provides a grip for a user; and a single handle arranged in said cavity.

13. The exercise device of claim 12, wherein said side wall includes (i) a curved wall portion and (ii) an extended or elongated portion extending upwardly from said curved wall portion, said step portion being situated between said curved wall portion and said extended or elongated portion.

14. The exercise device of claim 12, wherein a height of said side wall from a bottom surface of said side wall to a bottom-facing surface of said step portion is a substantially same height as a distance between an upper edge of said handle and said first edge of said body.

15. The exercise device of claim 12, wherein said at least one cut-out traverses said step portion.

16. The exercise device of claim 12, wherein said at least one cut-out comprises two cut-outs.

17. The exercise device of claim 16, wherein said two cut-outs are arranged on opposite sides of said side wall and align with one another.

18. The exercise device of claim 12, wherein said at least one cut-out has a substantially oval shape.

19. The exercise device of claim 12, wherein said at least one cut-out extends on said side wall from a point below said handle to a point above said handle.

20. The exercise device of claim 12, wherein said body further comprises a groove arranged in an inner surface of said body defining said cavity and opposite said rim.

21. The exercise device of claim 1, wherein said portion of said wall of said body extends beneath said rim around a complete periphery of said body.

22. The exercise device of claim 12, wherein said portion of said side wall of said body extends beneath said rim around a complete periphery of said body.

* * * * *